US009955845B2

(12) United States Patent
Fauth et al.

(10) Patent No.: US 9,955,845 B2
(45) Date of Patent: May 1, 2018

(54) METHOD FOR OPERATING A DISHWASHER

(75) Inventors: Michael Fauth, Pleinfeld (DE); Helmut Jerg, Giengen (DE); Kai Paintner, Adelsried (DE); Andreas Reiter, Finningen (DE); Roland Rieger, Rainau (DE)

(73) Assignee: BSH Hausgeräte GmbH, Munich (DE)

( * ) Notice: Subject to any disclaimer, the term of this patent is extended or adjusted under 35 U.S.C. 154(b) by 960 days.

(21) Appl. No.: 13/126,481

(22) PCT Filed: Oct. 16, 2009

(86) PCT No.: PCT/EP2009/063601
§ 371 (c)(1),
(2), (4) Date: Apr. 28, 2011

(87) PCT Pub. No.: WO2010/052116
PCT Pub. Date: May 14, 2010

(65) Prior Publication Data

US 2011/0203614 A1 Aug. 25, 2011

(30) Foreign Application Priority Data

Nov. 7, 2008 (DE) ..... 10 2008 043 576

(51) Int. Cl.
*A47L 15/48* (2006.01)
*A47L 15/00* (2006.01)

(52) U.S. Cl.
CPC ..... *A47L 15/0042* (2013.01); *A47L 15/481* (2013.01); *A47L 15/0002* (2013.01); *A47L 2401/12* (2013.01); *A47L 2401/18* (2013.01); *A47L 2501/11* (2013.01)

(58) Field of Classification Search
USPC ..... 134/56 D, 57 D, 58 D
See application file for complete search history.

(56) References Cited

U.S. PATENT DOCUMENTS

| | | | | |
|---|---|---|---|---|
| 3,448,561 | A * | 6/1969 | Seibert et al. | 95/10 |
| 2006/0278257 | A1 | 12/2006 | Jerg et al. | |
| 2007/0295373 | A1 | 12/2007 | Jerg et al. | |
| 2008/0149142 | A1* | 6/2008 | Jerg et al. | 134/25.2 |
| 2010/0101613 | A1* | 4/2010 | Jerg et al. | 134/56 D |

FOREIGN PATENT DOCUMENTS

| | | | |
|---|---|---|---|
| CN | 1829464 | A | 9/2006 |
| DE | 10353774 | A1 | 2/2005 |
| DE | 10353775 | A1 | 2/2005 |
| EP | 1706015 | B1 | 10/2009 |
| JP | 2006020753 | A | 1/2006 |
| WO | 2006056514 | A1 | 6/2006 |
| WO | WO 2008125517 | A1 * | 10/2008 |

OTHER PUBLICATIONS

International Search Report PCT/EP2009/063601.
Granting Decision RU 2011119250/12 dated Aug. 29, 2013.
Report of Examination CN 200980144506.7 dated Mar. 13, 2014.

* cited by examiner

*Primary Examiner* — David G Cormier
(74) *Attorney, Agent, or Firm* — Michael E. Tschupp; Andre Pallapies; Brandon G. Braun

(57) ABSTRACT

In a method for operating a dishwasher, a desorption process of a reversibly dehydratable dry material of a sorption-drying system is initiated at least at times. A parameter that influences the desorption process is hereby evaluated for determining an instant for performing the desorption process.

10 Claims, 4 Drawing Sheets

METHOD FOR OPERATING A DISHWASHER

BACKGROUND OF THE INVENTION

The invention relates to a method for operating a dishwasher, in particular a domestic dishwasher.

Dishwashers having what are termed sorption-drying systems for exothermally drying items to be washed that have been cleaned are known from DE 103 53 774 A1, DE 103 53 775 A1, and DE 10 2005 004 096 A1. During a partial program step of the dishwasher's respective dishwashing program "Dry" for drying washed items, moist air is therein ducted from the dishwasher's interior space serving as a washing container through a sorption container by means of a fan and moisture removed from the ducted-through air by the reversibly dehydratable dry material located in the sorption container. The reversibly dehydratable dry material is heated to very high temperatures for regenerating, which is to say desorbing the drying material. Water stored in said drying material thereby exits in the form of hot water vapor and is ducted into the washing container by an air current produced by means of the fan. Liquid and/or washed items that are located in the washing container as well as the air in the washing container can be heated thereby. A sorption-drying system of this kind has proved highly advantageous for drying crockery in a quiet, energy-saving manner.

BRIEF SUMMARY OF THE INVENTION

The object of the invention is to achieve a further improved desorption result for the sorption-drying device's reversibly dehydratable dry material.

The invention proceeds from a method for operating a dishwasher, in particular a domestic dishwasher, having a sorption-drying system in the case of which a desorption process of a reversibly dehydratable dry material, in particular zeolite, is initiated at least at times.

It is inventively provided for parameters that influence the desorption process to be evaluated for determining the instant for performing desorption. That makes it possible to guarantee efficient desorbing through coordinated selection of the instant at which the desorption process is to take place because it will thereby be ensured that the desorption process will be performed when the temperature of the air in the dishwasher's interior space is relatively at its lowest and hence the air's moisture-absorbing capacity is at its greatest.

In a development it is provided for the air temperature in the dishwasher and/or the water-feed temperature to be registered as parameters. It is thus possible to evaluate just the air temperature alone or the water-feed temperature alone or both temperatures together. The air temperature in the dishwasher therein depends on the room temperature in the region of the dishwasher's surroundings. The air temperature can, though, also deviate essentially from the room temperature if a washing program has run shortly before without the dishwasher's having been able to cool down. If only the air temperature or water-feed temperature is registered, the instant for performing desorbing can be determined using stored values, for example in table form. The extent of cooling due to refilling with liquid, in particular water from a domestic supply system, is therein established by the water-feed temperature. If, conversely, both the air temperature and the water-feed temperature are registered, a comparison can likewise take place with stored values and/or the difference between the two temperatures evaluated and used for determining the desorbing instant. The difference between said two temperature values is hence a measure for determining how far the temperature in the dishwasher's interior space will drop below the initial temperature. As an alternative to registering the air temperature it is possible also to provide for registering the room temperature alone or together with the water-feed temperature at the place where the dishwasher is located.

In a development it is provided for a desorption process to be performed at least in part during a first program step during which heating means belonging to the dishwasher are operated if the air temperature is at most a prespecified temperature value higher than the water-feed temperature. The heating means can therein be an air heater by means of which air being driven through the drying material can be heated. Excessive cooling through refilling with liquid is not to be expected in that case so that a desorption process will take place during the first program step during which liquid is heated such as, for example, the "Clean" program step or the "Pre-wash" program step if especially intensive cleaning is desired.

In a development it is provided for a desorption process to be performed at least in part during a program step during which heating means are operated after an at least partial change of liquid if the air temperature is at least a prespecified temperature value higher than the water-feed temperature. Significant cooling through refilling with liquid is in that case to be expected so that a desorption process will take place during the later program step before which refilling takes place as part of a change of liquid. That can be, for example, the "Clean" program step or the "Clear rinse" program step.

In a development it is provided for the prespecified temperature value to be selected as being essentially between 3 and 30° C., in particular between 5 and 15° C. It will hence be ensured that the instant at which the desorption process takes place will be postponed only in the event of large temperature differences in the case of which complete and efficient desorbing cannot be expected owing to the high initial temperature.

In a development it is provided for the desorption process to be performed at least in part during a "Clean" program step with the addition of a cleaning agent and with a cleaning action. This allows wash items to be cleaned particularly energy-efficiently.

In a development it is provided for the desorption process to be performed at least in part during a "Pre-wash" program step with a cleaning action but without the addition of a cleaning agent. Because of the heating associated therewith, the cleaning action can be intensified during the "Pre-wash" program step and hence during the washing program.

In a development it is provided for the desorption process to be performed at least in part during a "Clear rinse" program step with the addition of a rinse-aid. Because of the heating associated therewith, the drying action can be intensified during the ensuing "Dry" program step or, as the case may be, the duration of the "Dry" program step reduced.

In a development it is provided for an amount of liquid, in particular an amount of fresh water from a domestic water-supply system, to be intermediately stored in a water tank that is in thermally conducting contact with the dishwasher's surroundings. The water tank is therein filled at the end of a washing-program cycle so that in the time before the next washing-program cycle starts the amount of water intermediately stored in the water tank can heat up to room temperature proceeding from a water-feed temperature of for example 15° C. Said amount of liquid heated up to room temperature is used during a washing-program cycle for performing the "Pre-wash" washing-program step. Refilling with water from the water-supply system will result in corresponding cooling to below room temperature.

The object of the invention is further achieved by means of a dishwasher, in particular a domestic dishwasher, embodied to at least partially implement a desorption process of a reversibly dehydratable dry material, in particular zeolite, of a sorption-drying system during at least one program step of a plurality of program steps, with its being inventively provided for registering means for registering ambient-area parameters at the place where the dishwasher is located and evaluation means for determining the instant for performing desorption to be furnished.

Developments of the inventive dishwasher are indicated in the subclaims.

BRIEF DESCRIPTION OF THE DRAWINGS

The invention and its developments are explained in more detail below with the aid of drawings, in which.

DETAILED DESCRIPTION OF EXEMPLARY EMBODIMENTS OF THE PRESENT INVENTION

Figure 1:
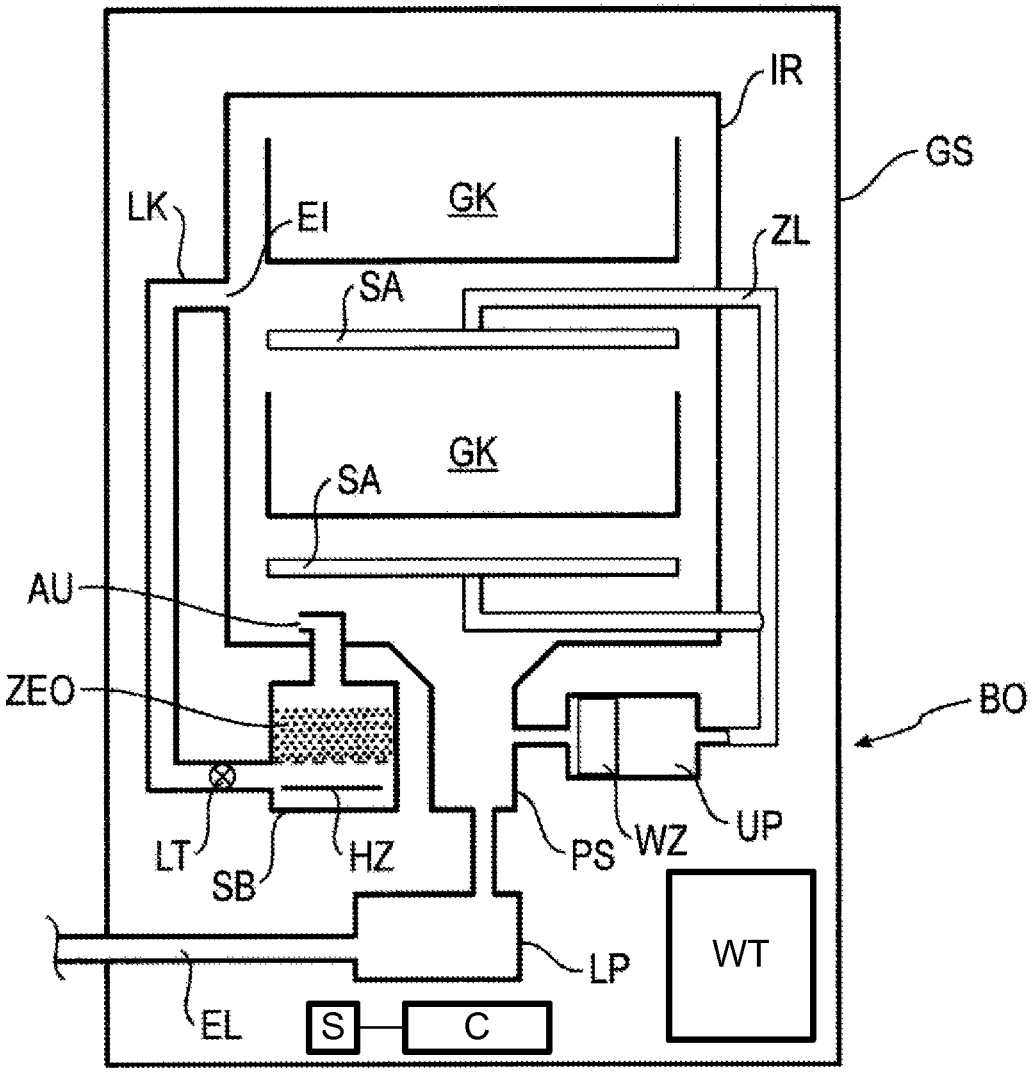
FIG. 1 is a schematic of an exemplary embodiment of an inventive dishwasher having a sorption-drying system.

Reference is made first to FIG. 1.

A dishwasher GS embodied in the present exemplary embodiment as a domestic dishwasher has an interior space IR that serves as a washing container and which for loading and unloading can be opened and closed by means of an attached door (not shown) capable of swiveling to the dishwasher GS. Provided for accommodating wash items in the interior space IR of the dishwasher GS are crockery baskets GK that can be pulled out from the interior space IR of the dishwasher GS to facilitate loading and unloading.

Provided in the interior space IR of the dishwasher GS for cleaning the wash items that have been placed in the crockery baskets GK are means embodied as spray arms SA for applying liquid to items requiring to be washed, with the liquid's possibly being, for example, water mixed with cleaning agents or with a rinse-aid in order in that way to effect a cleaning action or, as the case may be, streak-free drying. The liquid running off wash items collects in a pump sump PS located in the base region of the interior space IR of the dishwasher GS.

The spray arms SA are linked in a liquid-ducting manner via a supply line ZL to a circulating pump UP located along with other structural components of the dishwasher GS in a base module BO underneath the interior space IR of the dishwasher GS. During operation, which is to say when the circulating pump UP is running, the circulating pump UP draws up the liquid that has collected in the pump sump PS and conveys it through the supply line ZL to the spray arms SA. To heat the liquid circulated owing to the operation of the circulating pump UP, the circulating pump has an integrated water heater WZ for heating the liquid. A separate continuous-flow heater or other water heater can alternatively be provided alongside the circulating pump UP. A drain pump LP that is likewise in liquid-ducting contact with the pump sump PS and can be connected by means of a discharge line EL to a domestic wastewater disposal network is provided for emptying the interior space IR of the dishwasher GS.

The dishwasher GS furthermore has a sorption-drying system by means of which cleaned wash items that are located in the crockery baskets GR can be dried at the end of a washing-program cycle. Provided for that purpose in the base module BO is a sorption container SB connected in an air-ducting manner to an inlet EI via an air duct LK, with a fan LT being provided for producing a forced flow. A outlet opening AU is provided in the base region of the interior space IR of the dishwasher GS for conveying the air that was drawn up through the inlet EI and conveyed into the sorption container by the fan LT back into the interior space IR of the dishwasher GS.

For drying cleaned wash items, air is drawn in from the interior space IR of the dishwasher GS by the fan LT, ducted through the sorption container SB, and ducted back through the outlet opening AU into the interior space IR of the dishwasher GS. For drying the circulated air when that takes place, a drying means for performing exothermal drying is provided in the sorption container SB. Said means is a reversibly dehydratable dry material, for example zeolite, that absorbs water owing to its hydroscopic property, with thermal energy being released at the same time. The released thermal energy causes the circulated air to be heated, which simultaneously enhances the circulated air's moisture-absorbing capacity. At the end of a drying process an amount of liquid will have been stored in the drying material ZEO.

An air heater HZ which in the present exemplary embodiment is located in the sorption container SB is provided to reestablish the absorption capacity of the drying means ZEO for another washing-program cycle. It is, though, possible also to arrange an air heater outside the sorption container SB, for example in the air duct LK, to cause the air conveyed into the sorption container SB to be heated. To expel the amount of liquid stored in the drying material ZEO, an air current produced by means of the fan LT is heated so that the drying material ZEO can be heated to temperatures at which the amount of water stored in the drying material ZEO can be released again.

Figure 2:
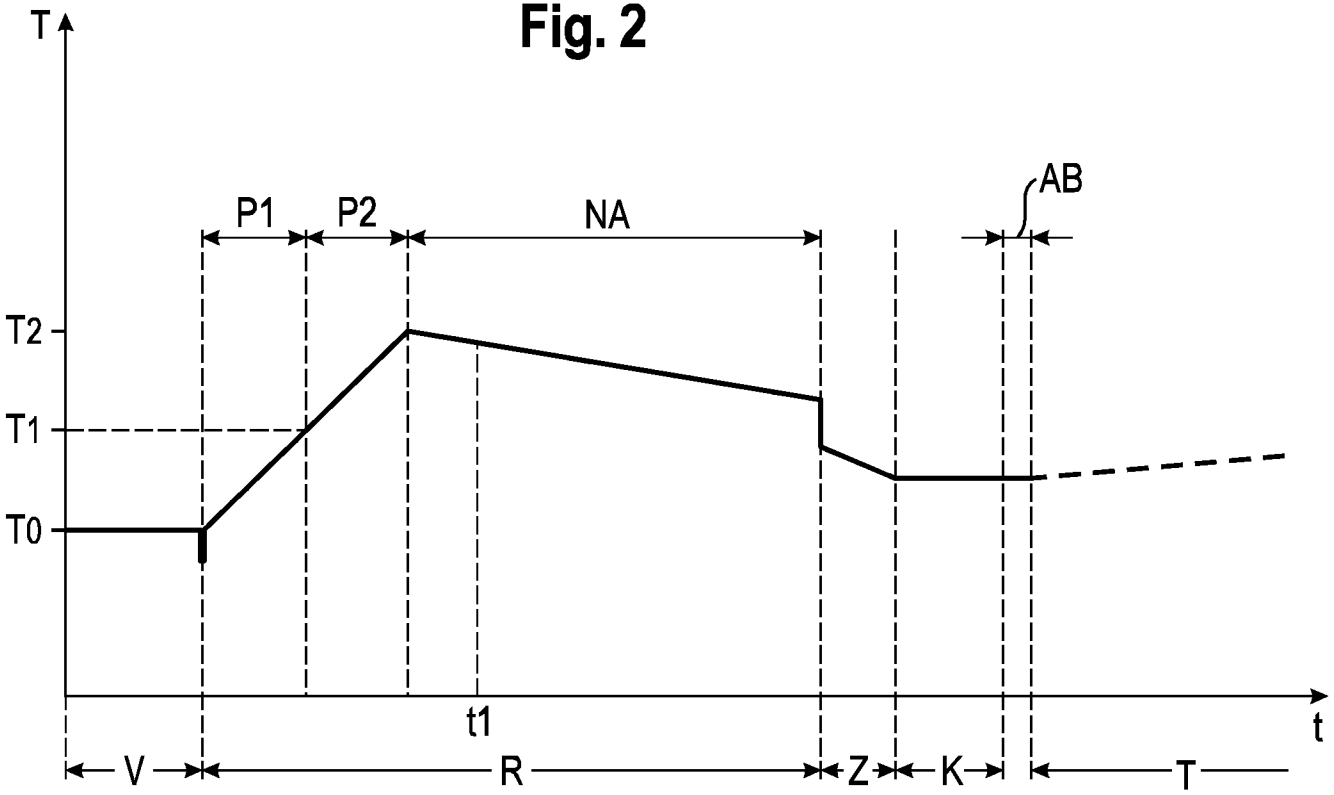
FIG. 2 is a schematic of the temperature curve during a first exemplary embodiment of an inventive washing-program cycle.
Figure 3:
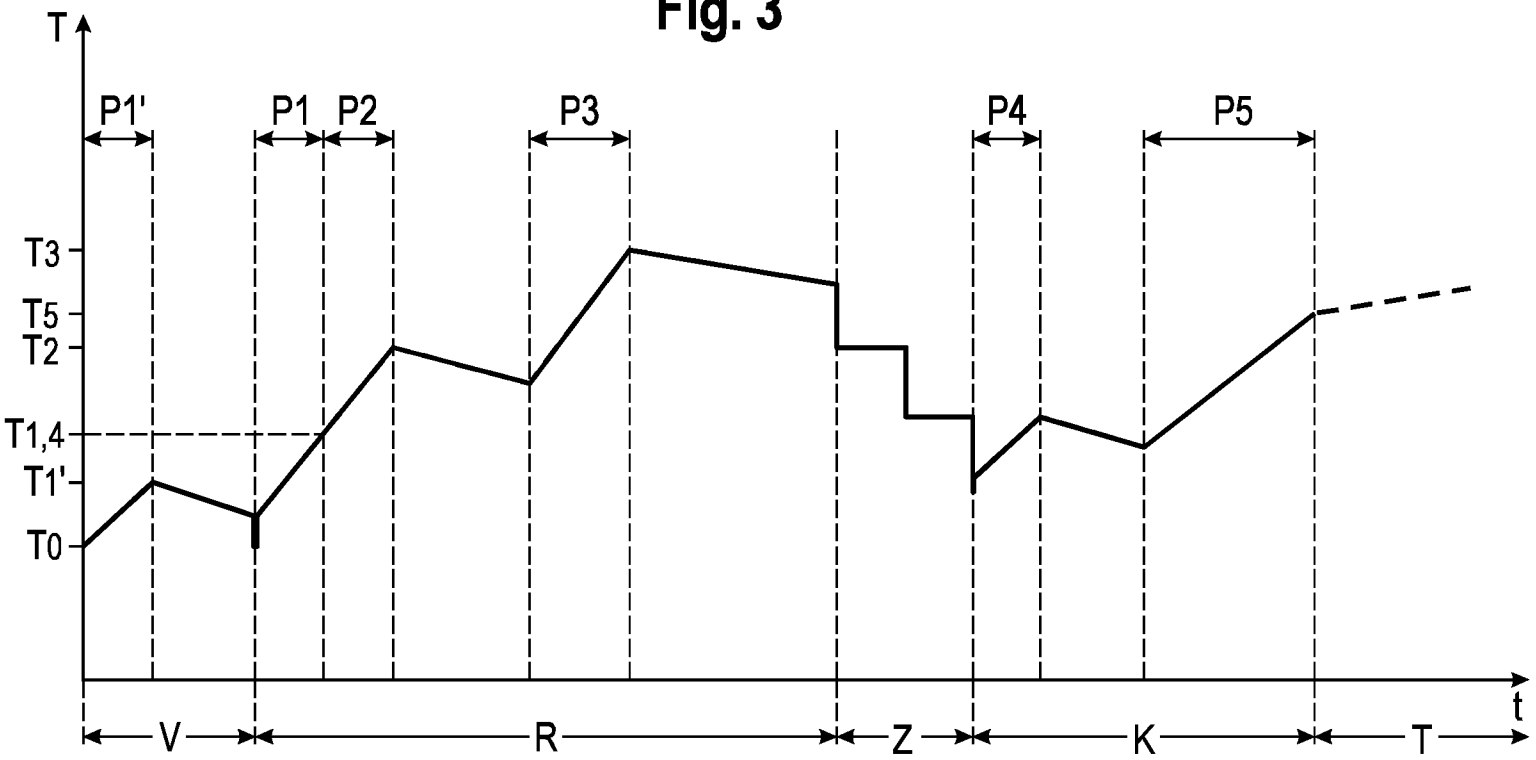
FIG. 3 is a schematic of the temperature curve of another, second exemplary embodiment of an inventive washing-program cycle.
Figure 4:
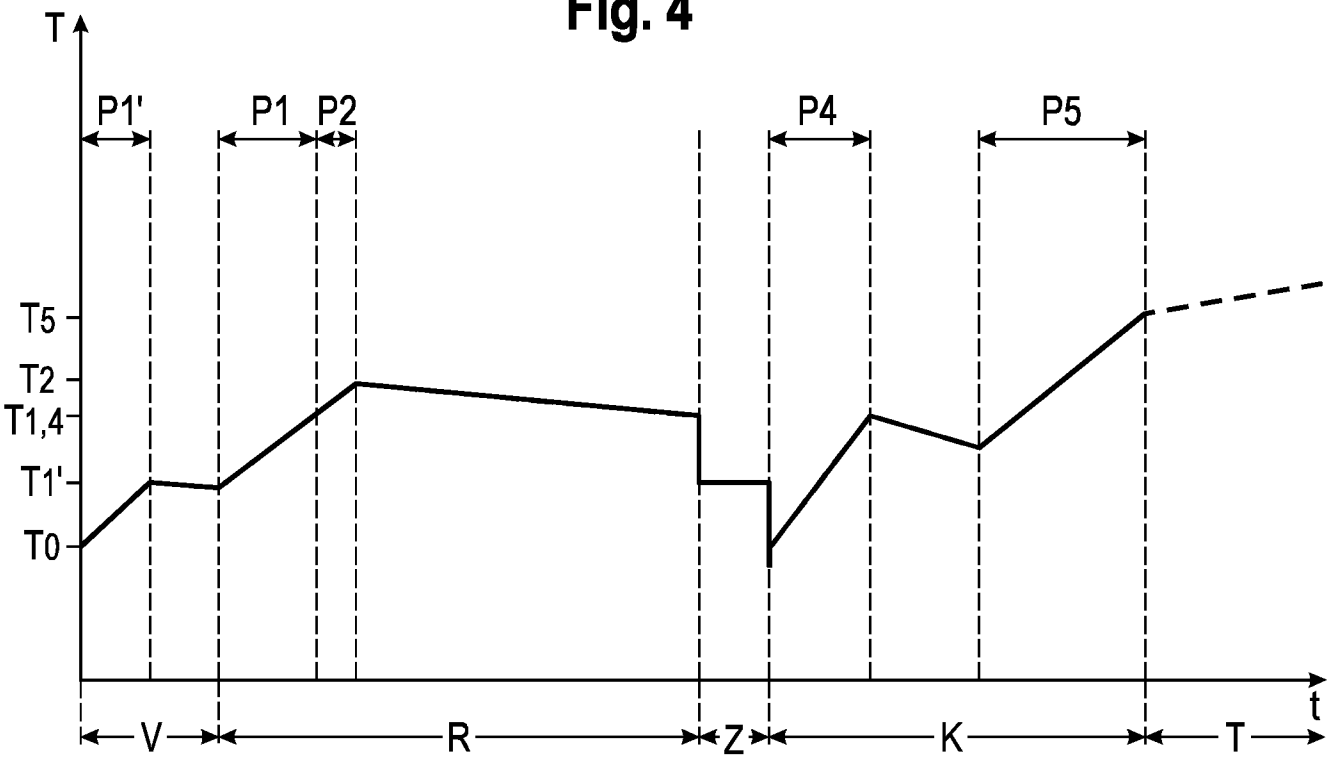
FIG. 4 is a schematic of the temperature curve of another, third exemplary embodiment of an inventive washing-program cycle.

Reference will now additionally be made to FIGS. 2 to 4.

For cleaning and drying items requiring to be washed, dishwashers GS run through washing programs consisting of a plurality of successively executed program steps. A program of said type can consist of the program steps V "Pre-wash", R "Clean", Z "Intermediate wash", K "Clear wash", and T "Dry", with its being possible also to omit individual program steps such as, for instance, V "Pre-wash" or Z "Intermediate wash", while it is conceivable also to execute individual program steps such as, for example, Z "Intermediate wash" more than once. During V "Pre-wash", for example water is applied to wash items without the addition of cleaning agents, with that taking place using either non-heated water or water heated by means of a heater. Water that has been stored in a water tank WT can be used for that purpose. A water tank of such kind can be in thermally conducting contact with the dishwasher's surroundings so that liquid intermediately stored in the water tank such as, for example, water from a domestic supply system can heat up to room temperature. Items requiring to be washed are cleaned during cleaning step R by applying water mixed with cleaning agents, which is to say that cleaning agents are added during the cleaning step. The liquid is furthermore heated to intensify the cleaning agent's cleaning action thereby. The cleaning step R is therein composed of a heating phase P1, P2 during which the liquid in the dishwasher GS is heated by means of heating means until a prespecified maximum temperature has been attained and of an ensuing post-washing phase during which, with the heating means switched off, the slowly cooling liquid is circulated by means of the circulating pump UP. During the program step Z "Intermediate wash", liquid is applied to the wash items to convey dirt residues from the dishwasher GS thereby. The next program step is K "Clear rinse"—for preparing the program step T "Dry"—during which water mixed with a rinse-aid is circulated by means of the circulating pump and applied via the spray arms SA to the cleaned wash items. Finally the program step T "Dry" is performed during which no further liquid is applied to the wash items but an air current circulating through the interior space IR of the dishwasher GS and the sorption container SB is produced through operation of the fan LT. The liquid can be changed completely or at least partially between the individual program steps, which is to say the dishwasher GS is emptied by means of the drain pump LP and discharge line EL and refilled again through a supply line (not shown) that establishes a connection to a domestic supply system.

In the washing-program cycle according to FIG. 2, liquid is heated only during the program step R "Clean". Proceeding from an initial temperature T0, the liquid circulated by means of the circulating pump UP is therein first heated during a first phase P1 in the sorption container SB to a maximum temperature T1 by the air heater HZ, with the fan LT simultaneously producing an air current circulating through the interior space IR of the dishwasher GS. The drying material ZEO in the sorption container SB is heated by the air heater HZ to temperatures at which the amount of water stored in the drying material ZEO will be expelled from the drying material ZEO and conveyed through the outlet opening AU in the interior space IR of the dishwasher GS. Said amount of liquid will have been heated through the action of the air heater HZ and hence cause the overall amount of liquid in the interior space IR of the dishwasher GS to heat up through mixing with the liquid already circulated by means of the circulating pump UP. Because heating up to the first temperature T1 is effected by means of the air heater HZ during the program step R "Clean", it will be ensured that the drying material ZEO can be reliably and completely desorbed through the circulating of relatively cold and dry air from the interior space IR of the dishwasher GS. Instead of a rigid washing-program cycle where a desorption process is performed during a first program section during which liquid is heated, it can in an alternative exemplary embodiment be provided also for parameters that influence the desorption process to be evaluated for determining the instant for performing desorption. Said parameters can be the air temperature and water-feed temperature registered by, for example, a register S. For example a desorption process can take place during a program step "Clean" or "Clear rinse" or even, if expedient, during the program step "Pre-wash", as determined by an evaluator C.

The outlet opening AU in the interior space IR of the dishwasher GS is cooled during desorbing by means of the air heater HZ to ensure thereby that the outlet opening AU will not be excessively heated owing to the heating capacity of the air heater HZ and damaged by overheating.

The circulating pump UP is operated for that purpose while the air heater HZ is operating, which is to say during phase P1, for example, so that liquid is conveyed by the circulating pump from the pump sump PS to the spray arm SA through the supply line. The spray arms SA are made to rotate thereby and by spraying the outlet opening AU, in particular a cap covering the outlet opening AU, with liquid will cause the same to cool.

During an ensuing phase P2 of the program step R "Clean" the amount of liquid is heated proceeding from the first temperature T1 to the second temperature T2 by means of the water heater WZ.

To intensify the cleaning action during of the program step R "Clean" it is provided for the spraying pressure of the water jets exiting the spray arm SA to be raised by increasing the rotational speed of the circulating pump UP. For that purpose during the program step R "Clean" the amount of liquid circulated by means of the circulating pump UP is increased during the post-washing phase NA by means of a refilling step, for example at the instant t1 (see FIG. 2), and the rotational speed of the circulating pump UP then increased for example continuously until the circulating pump is again running under concentric-running conditions, which is to say is not drawing up any air bubbles during its operation, which reduces the conveying capacity of the circulating pump UP and results in the production of undesired noise. It is thereby possible when the amount of liquid required for refilling is dimensioned to take account of the amount of liquid released during desorbing having been stored in the drying material ZEO and hence to reduce the overall water requirements while enhancing cleaning performance at the same time.

Provided between the program step K "Clear rinse" and the program step T "Dry" is a draining phase AB (see FIG. 2) during which liquid, which is to say water mixed with a rinse-aid, adhering to the cleaned wash items can run off said items owing to the effect of gravity and collect in the pump sump PS of the interior space IR of the dishwasher GS. The amount of liquid requiring to be taken up by the sorption-drying system will be reduced thereby as will hence the duration of the program step T "Dry".

Before said draining phase AB, which is to say at the end of the program step K "Clear rinse", a pumping-away operation is performed during which the liquid mixed with a rinse-aid is conveyed by means of the drain pump LP into a domestic wastewater disposal system through the discharge line EL. That is followed by the draining phase AB during which neither circulating pump UP, nor the drain pump LP, nor the fan LT, nor any of the cited heaters HZ, WZ is in operation. On expiration of said draining phase AB the program step T "Dry" begins by powering on the fan LT so that an air current circulating through the interior space IR of the dishwasher and the sorption container SB will be produced in order to dry the cleaned wash items that are in the crockery baskets GK. At the end of the program step T "Dry" another pumping-away operation is performed by the drain pump LP, by means of which any remaining amount of liquid will be conveyed out of the dishwasher GS into a domestic waste-water-disposal system through the discharge line EL. It can alternatively thereto be provided also for another pumping-away operation to be performed additionally or alternatively at the start of the program step T "Dry".

Liquid is heated during the first of the program steps, the program step V "Pre-wash", in the case of the washing program according to FIGS. 3 and 4. Liquid is heated for that purpose, proceeding from an initial temperature T0 during a phase P1' to a temperature T1' by means of the air heater HZ by, as described above, producing an air current circulating through the interior space IR of the dishwasher and the sorption container SB using the fan LT. The air heater HZ will be deactivated when the temperature T1' has been attained. The drying material ZEO will not yet be fully desorbed at that time, which is to say a residual amount of water will be stored in the drying material ZEO. To expel said residual amount of water from the drying material ZEO and thereby have a drying material ZEO fully capable once more of absorbing water available again at the start of the program step T "Dry", during the ensuing program step R "Clean" the liquid is first heated by means of the air heater HZ to a temperature T1 and then heated to the temperature T2 through the water heater's operation. That means the desorption phase of the drying means ZEO in the sorption container SB has been divided in two in this exemplary embodiment and is distributed between two program steps, namely the program step V "Pre-wash" and the program step R "Clean".

Another phase P3 (see FIG. 3) during which the liquid is further heated to a temperature T3 by means of the water heater WZ can be provided to intensify the cleaning action through a further increase in temperature.

It is provided in the exemplary embodiments according to FIGS. 3 and 4 for the liquid to be heated during the clear-rinsing step K in order to improve the drying result at the end of the program step T "Dry". Liquid that is water or water mixed with a rinse-aid is for that purpose heated to a temperature T4 during a phase P4 by means of the water heater WZ. The air heater HZ can alternatively also be used for that purpose instead of the water heater in order, for example, to complete a desorbing process that was not performed fully during the program run. The liquid can additionally be further heated to a temperature T5 during another phase P5 to improve drying by means of the sorption-drying system.

LIST OF REFERENCES

AB Draining phase
AU Outlet opening
BO Base module
EI Inlet
EL Discharge line
GK Crockery basket
GS Dishwasher
HZ Air heater
IR Interior space
LK Air duct
LP Drain pump
LT Fan
NA Post-washing phase
P1' Phase 1'
P1 Phase 1
P2 Phase 2
P3 Phase 3
P4 Phase 4
P5 Phase 5
PS Pump sump
SA Spray arm
SB Sorption container
t1 Refilling instant
T0 Initial temperature
T1' Temperature
T1 Temperature
T2 Temperature
T3 Temperature
T4 Temperature
T5 Temperature
UP Circulating pump
WZ Water heater
ZEO Drying material
ZL Supply line

The invention claimed is:

1. A dishwasher, comprising:
a dishwashing chamber in which dishes are washed;
a sorption-drying system that performs a desorption process of a reversibly dehydratable dry material;
a register configured to register a parameter that influences the desorption process; and
an evaluator configured to evaluate the parameter registered by the register to determine when to perform the desorption process;
wherein the parameter is a member selected from the group consisting of an air temperature in the dishwashing chamber and a water-feed temperature of water fed into the dishwashing chamber.

2. The dishwasher of claim 1, wherein the evaluator is constructed such that the desorption process is performed at least in part during a first program step of a plurality of program steps while a heater of the dishwasher is rendered operative, when the air temperature in the dishwashing chamber exceeds the water-feed temperature by a maximum prespecified temperature value.

3. The dishwasher of claim 1, wherein the evaluator is constructed such that the desorption process is performed at least in part during a first program step of a plurality of program steps while a heater of the dishwasher is rendered operative, when the air temperature in the dishwashing chamber exceeds the water-feed temperature by a minimum prespecified temperature value.

4. The dishwasher of claim 2, wherein the prespecified temperature value ranges essentially between 3 to 30° C.

5. The dishwasher of claim 2, wherein the prespecified temperature value ranges essentially between 5 and 15° C.

6. The dishwasher of claim 3, wherein the prespecified temperature value ranges essentially between 3 to 30° C.

7. The dishwasher of claim 3, wherein the prespecified temperature value ranges essentially between 5 and 15° C.

8. The dishwasher of claim 2, wherein the heater is an air heater.

9. The dishwasher of claim 3, wherein the heater is an air heater.

10. A dishwasher, comprising:
a dishwashing chamber in which dishes are washed;
a sorption-drying system that performs a desorption process of a reversibly dehydratable dry material;
an air duct for channeling moist air from the dishwashing chamber to the reversibly dehydratable dry material;
a register configured to register a parameter that influences the desorption process, the parameter being registered at a location inside the dishwashing chamber; and
an evaluator configured to evaluate the parameter registered by the register to determine when to perform the desorption process.

* * * * *